US006020117A

United States Patent [19]

Bauer et al.

[11] Patent Number: 6,020,117

[45] Date of Patent: Feb. 1, 2000

[54] THERMALLY PROCESSABLE IMAGING ELEMENT

[75] Inventors: Charles L. Bauer, Webster; Michael J. Ritz, Rochester, both of N.Y.

[73] Assignee: Eastman Kodak Company, Rochester, N.Y.

[21] Appl. No.: 09/164,157

[22] Filed: Sep. 30, 1998

[51] Int. Cl.[7] ..... G03C 1/76; G03C 1/38

[52] U.S. Cl. ..... 430/536; 430/523; 430/531; 430/539; 430/631; 430/638; 430/961; 430/964

[58] Field of Search ..... 430/523, 531, 430/536, 539, 631, 638, 961, 964

[56] References Cited

U.S. PATENT DOCUMENTS

| | | | |
|---|---|---|---|
| 3,080,254 | 3/1963 | Grant, Jr. | 430/964 |
| 4,741,992 | 5/1988 | Przezdziecki | 430/523 |
| 4,828,971 | 5/1989 | Przezdziecki | 430/531 |
| 4,886,739 | 12/1989 | Przezdziecki | 430/531 |
| 5,204,233 | 4/1993 | Ogasawara et al. | 430/539 |
| 5,310,640 | 5/1994 | Markin et al. | 430/527 |
| 5,418,120 | 5/1995 | Bauer et al. | 430/523 |
| 5,468,603 | 11/1995 | Kub | 430/619 |
| 5,547,821 | 8/1996 | Melpolder et al. | 430/527 |
| 5,578,548 | 11/1996 | Bjork et al. | 503/202 |

OTHER PUBLICATIONS

Research Disclosure, vol. 170, Jun. 1978, Item 17029.

*Primary Examiner*—Richard L. Schilling
*Attorney, Agent, or Firm*—Carl O. Thomas; J. Lanny Tucker

[57] ABSTRACT

A thermographic or photothermographic element is disclosed having a surface coating containing a film-forming binder overlying at least one major surface of the element. An alkoxysilane containing at least one saturated hydrocarbon substituent having at least 8 carbon atoms is confined to the surface coating to act as a friction reducing compound.

13 Claims, No Drawings

THERMALLY PROCESSABLE IMAGING ELEMENT

FIELD OF THE INVENTION

This invention relates to thermally processable imaging elements. The invention relates more particularly to thermographic and photothermographic elements.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. A summary of common types of photothermographic element constructions is provided by *Research Disclosure*, Vol. 170, June 1978, Item No. 17029. *Research Disclosure* is published by Kenneth Mason Publications, Ltd., Dudley House, 12 North St., Emsworth, Hampshire P010 7DQ, England. Many of these photothermographic element constructions are also useful as thermographic elements. Most photothermographic elements that rely on photosensitive silver halide to catalyze an image-forming oxidation-reduction reaction can be used as thermographic elements. When use exclusively as a thermographic element is contemplated, a common modification is to omit the photosensitive silver halide and to rely on the imagewise application of heat to drive the image-forming oxidation-reduction reaction, as illustrated by Grant U.S. Pat. No 3,080,254.

It is common practice to include a surface coating in the construction of a thermally processable element. For example, a surface coating can take the form of a transparent coating overlying one or more image-forming layers. Additionally or alternatively, the surface coating can be located to form the back surface of the element on the side of the support opposite the image layer.

In addition to the variety of functions that surface coatings are recognized to perform in imaging elements generally, such as adhesion to the underlying portion (i.e., layer or support) of the element, optical transparency as required (including resistance to fingerprints and scratches), low transport friction, low self-adhesion (necessary for use of spool wound or stacked sheet elements), and sensitometric compatibility with the imaging layers, the surface coatings of thermally processed elements are also commonly relied upon to resist deformation during thermal processing and, to reduce or prevent loss of volatile components during thermal processing. Also, unlike imaging elements that rely on penetration by aqueous processing solutions, the surface coatings of thermally processable elements need not be water permeable and often serve their purpose better when relatively impermeable. In thermally processable elements imaging layer overcoats are often referred to as barrier layers. As a result of differing functional requirements, most conventional selections of surface coatings for thermally processable elements have taken specialized forms unsuited for imaging elements generally.

*Research Disclosure*, Item No. 17029, cited above, XI Overcoat Layers, catalogues known overcoat components of photothermographic elements.

These subsequent patents illustrate further developments in the art:

Przezdziecki U.S. Pat. Nos. 4,741,992 and 4,828,971 teach the use of polysilicic acid in a surface coating of a thermally processable element. The polysilicic acid is taught to be useful with compatible water soluble hydroxyl containing monomers and polymers.

Przezdziecki U.S. Pat. No. 4,886,739 further teaches incorporation in the imaging layer of at least one hydrolyzed polyalkoxysilane—that is, hydrolyzed $Si(OR_1)_4$ or hydrolyzed $R_2—Si(OR_3)_3$, to increase image density. These addenda in a hydrophobic imaging layer are further taught to enable increased adhesion of the imaging layer to a hydrophilic overcoat. $R_2$ is described as a substituted or unsubstituted alkyl or phenyl substituent. To further promote layer adhesion the use of a hydrolyzed polyalkoxysilane in an overcoat layer overlying the imaging layer is optional. Thus, hydrolyzed polyalkoxysilane is contemplated to be present in the imaging layer or both the imaging layer and an overcoat.

Markin et al U.S. Pat. No. 5,310,640 teaches incorporation of polysilicic acid as disclosed in Przezdziecki U.S. Pat. No. 4,741,992 in an overcoat for a limited resistivity (antistatic) backing layer of a thermally processable element.

To prevent self-adhesion (commonly referred to as blocking) of spooled or stacked thermally processable elements, it is common practice to incorporate matting particles. The surface protrusions created by the matting particles create spatial separations between the surfaces of adjacent elements to reduce blocking. Matting particles, also referred to as matting agents or fillers, are disclosed, for example, in *Research Disclosure* Item No. 17029, XI. Overcoat layers; Przezdziecki U.S. Pat. No. 4,828,971; Mack et al U.S. Pat. No. 5,198,406; Melpolder et al U.S. Pat. No. 5,547,821; Kub U.S. Pat. No. 5,468,603; and Bjork et al U.S. Pat. No. 5,578,548.

Transport of thermally processable elements can also be facilitated by reducing their surface friction independent of the presence or absence of matting particles. This is, however, by comparison infrequently discussed. For example, none of the citations above, except Bjork et al, identify any ingredient, except matting particles, as being introduced for the purpose of facilitating element transport. Bjork et al suggests the optional use of siloxane diamine as a "slip agent" in the topcoat of a thermographic element.

SUMMARY OF THE INVENTION

In one aspect, this invention is directed to a thermally processable imaging element, said element being comprised of (a) a support; (b) at least one thermographic or photothermographic imaging layer coated on the support, and (c) a surface coating containing a film-forming binder overlying at least one major surface of the element, WHEREIN a friction reducing compound is confined to the surface coating and is represented by the formula:

$$(R^1)_{4-y}—Si—(OR^2)_y$$

in which $R^1$ consists of a saturated hydrocarbon containing from 8 to 32 carbon atoms, $R^2$ is an alkyl group of from 1 to 4 carbon atoms, and y is an integer of from 1 to 3.

As demonstrated in the Examples below, the incorporation of the formula compound in the surface coating reduces the surface friction of the thermally processable element, thereby facilitating its transport in handling prior to and following image formation. The reduction in surface friction renders the thermally processable elements particularly suitable for use in automated equipment used to supply the elements for imaging and to deliver the image bearing elements.

It has been demonstrated quite unexpectedly that superior reduction in surface friction is realized only when the substituent $R^1$ of the formula compound consists of a saturated hydrocarbon. When the hydrocarbon substituent contains a functional substituent, as is taught by Przezdzieki U.S. Pat. No. 4,886,739 for adhesion promoting addenda, the desired property of reduced surface friction is adversely affected.

It has been further demonstrated that confining the formula compound to the surface coating instead of placing the formula compound in the surface coating and an underlying imaging layer, as taught by Przezdzieki U.S. Pat. No. 4,886,739, is essential to realizing desirable levels of adhesion of the surface coating to the underlying layer.

Thus, the function, selection and placement of the formula compound in the practice of this invention differs from that of formula and formula-like compounds previously taught for incorporation in thermally processable elements.

DETAILED DESCRIPTION OF THE INVENTION

The minimum required components of a thermally processable element satisfying the requirements of the invention are illustrated by the following elements:

| |
|---|
| Surface Coating |
| Imaging Layer Unit |
| Support |

Element A

| |
|---|
| Imaging Layer Unit |
| Support |
| Surface Coating |

Element B

In both Elements A and B the Surface Coating reduces surface friction.

In Element A the binder of the Surface Coating additionally offers physical protection to the Imaging Layer Unit. In Element A the Surface Coating is positioned to act also as a barrier layer, preventing, if desired, reactants from entering or leaving the Imaging Layer Unit. In this element image generation and viewing usually occur through the Surface coating. Thus, the Surface Coating, when overlying the Imaging Layer Unit, is preferably transparent and colorless. For reflection viewing of the image, the Support is preferably white. For transmission viewing of the image, the Support is transparent and preferably colorless.

In Element A, when the Support is transparent, the Surface Coating can be opaque. In this form, when Element A is a photothermographic element, it can be exposed and viewed through the transparent support. When the element is exposed through the Support, the Surface Coating can additionally act as an antihalation layer, if desired. In this form, when Element A is a thermographic element, it can be imagewise heated through the opaque Surface Coating, and the resulting image can be viewed through the transparent support.

In Element B the support can be transparent (preferably colorless) or reflective (preferably white). When imaging and viewing occur from the upper (as shown) side of the support, as is usually practiced and the Support is reflective, it is immaterial whether the Surface Coating is transparent or opaque. When the Support is transparent, the Surface Coating is also transparent to allow transmission viewing. When the Support is transparent, the Surface Coating can additionally function as an antihalation layer during photoexposure, but must be decolorized during process to permit transmission viewing. When the Support is flexible, the Surface Coating can act to balance forces applied to the Support by the Imaging Layer Unit—e.g., the Surface Coating can additionally act as an anticurl layer.

The Surface Coating can occupy only one major face of the element, as shown in Elements A and B, or both major surfaces as shown in Element C:

| |
|---|
| Surface Coating |
| Imaging Layer Unit |
| Support |
| Surface Coating |

Element C

The varied forms of the upper and lower (as shown) Surface Coatings are apparent from the previous discussion of Elements A and B.

Although the lower (as shown) Surface Coating can additionally act as an antihalation and/or anticurl layer, if desired, it is usually preferred to incorporate a separate antihalation and/or anticurl layer, as illustrated by the following elements:

| |
|---|
| Surface Coating |
| Imaging Layer Unit |
| Antihalation Layer |
| Support |
| Surface Coating |

Element D

| |
|---|
| Surface Coating |
| Imaging Layer Unit |
| Antihalation Layer |
| Support |
| Anticurl Layer |
| Surface Coating |

Element E

| |
|---|
| Surface Coating |
| Imaging Layer Unit |
| Support |
| Anti-Curl/Antihalation Layer |
| Surface Coating |

Element F

In Elements D, E and F, both Surface Coatings preferably satisfy the requirements of the invention, but only one Surface Coating satisfying the requirements of the invention is necessary. The remaining Surface Coating can be omitted or can take any conventional form.

When thermally processable elements according to the invention are employed to record medical radiographic images, any of the various forms of Elements A through F discussed above can be employed. In medical diagnostic practice, it is preferred that radiographic images be viewed on a light box. Light is transmitted to the viewer from a white translucent surface through that the image bearing element. To avoid visual fatigue and by established practice the radiographic element is preferably blue tinted. A preferred location for tinting dyes is in the Support, but any of the light transmitting layer can incorporate a tinting dye. A common practice to is to locate a base level of blue tinting dye in the Support and to adjust the level of tinting to its preferred final level for a particular application by incorporating a supplemental level of tinting dye in one or more of the transparent layers of the element. Preferably the tinting dye is not interposed between an exposing light source and the Imaging Layer Unit.

When thermally processable elements are employed to provide radiographic images for viewing, they are most commonly used to provide viewable copies of radiographic images that have been previously captured and stored in digital form in an electronic memory. Photodiodes or lasers are commonly employed as light sources for exposure. The copy provides the radiologist with an image that is visually similar to that provided by conventional radiographic elements used for image capture.

It is alternatively possible to employ thermally processable elements according to the invention for capture of X-radiation images. The photothermographic forms of Elements A through F can be employed for capturing X-radiation images. The X-radiation exposure can be at low (diagnostic) levels or higher levels used for radiation therapy. In X-radiation image capture, it is common practice to coat Imaging Layer Units on both major faces of the Support. These elements are commonly referred to as dual-coated elements. A typical dual-coated element construction is illustrated by the following:

| |
|---|
| Front Surface Coating |
| Front Imaging Layer Unit |
| Support |
| Back Imaging Layer Unit |
| Back Surface Coating |

Element G

In Element G the Support is transparent and preferably blue tinted. The "Front" designation indicates a position between the Support and the source of X-radiation while the designation "Back" indicates a position that receives X-radiation after passing through the Support. Only one of the Surface Coatings is required, and one only one of the Surface coatings need satisfy the requirements of the invention. Since symmetrical (identical front and back) constructions are primarily used for dual-coated radiographic elements, it is preferred that the Front and Back Surface coatings be identical. However, asymmetrical constructions for the Front and Back Imaging Layers Units have been employed to obtain differing front and back images, each optimized for a different anatomical feature of the patient being examined.

Dickerson and Paul U.S. Pat. No. 5,738,981, here incorporated by reference, illustrates a dual-coated format applied to elements intended to capture digitally stored radiographic images. The dual-coated elements of Dickerson and Paul are exposed by photodiodes or a laser from one side. Thus, it is apparent that Element G can be exposed from one side by light or from one side by X-radiation.

More typically, a dual-coated radiographic element is mounted for exposure between a pair of Front and Back Intensifying Screens, which are separated from the radiographic element before thermal processing. Each Intensifying Screen absorbs X-radiation, received in an image pattern, and emits light in a corresponding image pattern. The light emitted by the Front Screen imagewise exposes the Front Imaging Unit while the light emitted from the Back Screen imagewise the Back Imaging Unit. Since the Support is transparent, a portion of the light emitted by the Front Intensifying Screen can also expose the Back Imaging Unit and a portion of the light emitted by the Back Intensifying Screen can also expose the Front Imaging Unit. These unwanted additional exposures, commonly referred to as crossover, reduce image sharpness.

A preferred dual-coated radiographic element construction that can reduce or eliminate light crossover is illustrated by the following assembly, illustrating both crossover reduction and the components described in the preceding paragraph:

| |
|---|
| Front Intensifying Screen |
| Front Surface coating |
| Front Imaging Layer Unit |
| Crossover Control Layer |
| Support |
| Crossover Control Layer |
| Back Imaging Layer Unit |
| Back Surface coating |
| Back Intensifying Screen |

Element H + Screens

While only one Crossover Control Layer is required to control crossover, two such layers are usually employed to avoid element asymmetry, requiring control of front and back orientation during exposure to obtain replicable images.

The thermally processable elements of the invention exhibit reduced surface friction as a result of including in at least the Surface Coating on one major face of the element and preferably in the Surface Coatings on both major faces an alkoxysilane satisfying the formula:

$$(R^1)_{4-y}—Si—(OR^2)_y \quad (I)$$

in which $R^1$ consists of a saturated hydrocarbon containing from 8 to 32 carbon atoms, $R^2$ is an alkyl group of from 1 to 4 carbon atoms, and y is an integer of from 1 to 3.

$R^1$ is required to be a saturated hydrocarbon. The term "hydrocarbon" is used in its chemically recognized sense as extending to moieties that contain only hydrogen and carbon atoms. The term "saturated" is used to indicate the presence of only highly stable carbon-to-carbon bonds, such as those found in aliphatic compounds having only single carbon-to-carbon bonds and those having carbon-to-carbon bonds found in aromatic rings. Hydrocarbons having aliphatic carbon-to-carbon double bonds and carbon-to-carbon triple bonds are excluded by the "saturated" requirement. Stated in an alternative quantitative way, the saturated hydrocarbon moieties contemplated to form $R^1$ have carbon-to-carbon bond lengths of $\geqq$1.39 Angstroms, which are the accepted carbon-to-carbon bond lengths of benzene. By comparison the carbon-to-carbon bond lengths of alkanes are in the vicinity of 1.50 Angstroms. The known ability of both alkanes and aromatic carbocyclics to assume planar steric configurations is considered an important component of their utility in the formula (I) compounds.

As demonstrated in the Examples below, saturated hydrocarbon moieties with low numbers of carbon atoms do not provide the desired levels of friction reduction. It is accordingly contemplated to employ saturated hydrocarbon moieties for $R^1$ that exhibit at least 8 carbon atoms, preferably at least 12 carbon atoms. Friction reducing characteristics are not adversely affected by large numbers of carbon atoms in the $R^1$ hydrocarbon moieties. However, to avoid needless molecular bulk, it is contemplated to limit the number of carbon atoms to 32 (preferably 24) or less. The carbon atoms in the $R^1$ hydrocarbon moiety are preferably limited to 20 or less.

Although the term "hydrocarbon" is sometimes loosely used to include compounds and moieties that include substituents containing atoms other than hydrogen and carbon, as demonstrated in the Examples below functionally substituted hydrocarbons, such as those employed by Przezdziecki U.S. Pat. No. 4,886,739 interchangeably with unsubstituted hydrocarbons, have been found deleterious to friction reducing properties.

Only one occurrence of $R^1$ in the formula (I) compound is required to impart desirable friction reducing properties. Additional incorporations of $R^1$ moieties are considered beneficial, but not essential. Up to three occurrences of $R^1$ in the formula (I) compound are contemplated.

At least one silicon substituent in formula (I) is an alkoxy group containing from 1 to 4 carbon atoms—i.e., methoxy, ethoxy, n-propoxy or iso-propoxy. Up to three alkoxy groups can be present. When more than one alkoxy group is present, the alkoxy groups can be the same or different.

Although $R^2$ in the formula (I) compound contains one or more alkyl groups when introduced into the surface coating, it is well recognized in the art that silicon bonded alkoxy groups hydrolyze to form silicon-oxygen linkages:

$$Y—Si—OR^2+R^2O—Si—Y \rightarrow Y—Si—O—Si—Y \quad (II)$$

where Y represents the substituents of Si in formula (I) other than the one occurrence of $OR^2$ shown. When a single occurrence of $OR^2$ is present in formula (I), two molecules can condense into a single product compound, thereby nearly doubling the original molecular weight. With two occurrences of $OR^2$ in the formula (I) compound, a linear polymer having an —(O—Si—) repeating unit backbone can be generated; and, with three $OR^2$ occurrences in the formula (I) compound, a crosslinked polymer can be generated by a condensation reaction in the surface coating. Thus, the function of the $OR^2$ moiety is that of immobilizing the formula (I) compound in the surface coating.

However, prior to the formula (I) compound being immobilized by the condensation reaction, which is a relatively slow reaction, the formula (I) compound can migrate to the air interface of the surface coating. This surface seeking quality of the formula (I) compound is considered to be a major contributor to its friction reducing capability.

This surface seeking quality of the formula (I) compound also establishes its effective concentrations as being independent of the concentrations of other components in the surface coating. More specifically, the alkoxysilanes of formula (I) are effective in the Surface Coating(s) in coating densities as low as 0.005 (preferably 0.01) $g/m^2$ over conventional ranges of other possible Surface Coating components, such as binders, surfactants, matting agents, etc. Obviously no useful purpose is served in providing formula (I) coating densities above those required to provide full surface coverage. In the interest of efficient use of materials, the formula (I) coating densities are contemplated to range up to 0.1 (preferably up to 0.05) $g/m^2$. Formula (I) coating coverages of up to 1.0 $g/m^2$ or higher are considered useful.

In addition to the formula (I) alkoxysilane the Surface coating(s) contain a film-forming binder of any convenient conventional form. The film-forming binder is preferably a water soluble hydroxyl containing polymer, such as poly (vinyl alcohol) or a water soluble cellulose derivative, such a cellulose ester (e.g., cellulose acetate or butyrate). The film-forming binder is coated at any convenient level sufficient to insure complete surface coverage by the Surface coating(s). A preferred minimal coating coverage is at least 0.5 $g/m^2$. Preferred coating coverages of the film-forming binder are less than 2.0 $g/m^2$.

Only the film-forming binder and formula (I) alkoxysilane are required in the Surface Coating(s). Other conventional addenda, including addenda specifically discussed below for incorporation in the Surface Coating(s) can be omitted or alternatively located in a separate layer (i.e., an interlayer) interposed between the any one of the Surface coatings described above and its disclosed substrate.

In a preferred form of the invention the Surface Coating (s) contain both a formula (I) compound and poly(silicic acid), typically represented by the formula:

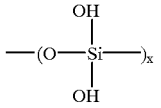

wherein x is an integer sufficient to provide a coatable aqueous solution of poly(silicic acid), such as an integer within the range of from at least 3 to about 600. The poly(silicic acid) can be incorporated by any conventional technique. A preferred technique is to incorporate tetraethyl ortho silicate, which then hydrolyzes in situ to form the poly(silicic acid). The barrier function of the Surface Coating(s) overlying the Imaging Layer Unit is enhanced by the presence of the polysilicic acid. Additionally, the alkoxysilane of formula (I) can enter into a condensation reaction with the free hydroxyl groups of the poly(silicic acid). Thus, the alkoxysilane of formula (I) can become attached to a polymer for immobilization, even when only one alkoxy substituent is present in the molecule. When present, the poly(silicic acid) preferably accounts for from 50 to 90 weight percent of the total weight of the Surface Coating(s).

The overcoat and backing coat formula (III) poly(silicic acid) and film-forming binder teachings of Przezdziecki U.S. Pat. Nos. 4,741,992, 4,828,971 and 4,886,739, cited above and here incorporated by reference, are specifically contemplated for the Surface coating constructions satisfying the requirements of this invention.

In addition to the ingredients noted above the Surface Coating(s) and all coated layers of the thermally processable elements of the invention preferably contain one or more surfactants. Any of a broad range of conventional surfactants, including particularly anionic and non-ionic surfactants and combinations thereof are contemplated. The surfactants are effective in small amounts, typically less than 5 percent by weight based on total weight, in assuring coating uniformity. A summary of useful addenda of this type is included in *Research Disclosure*, Item No. 17029, X. Coating Aids.

Conventional conductivity increasing (antistatic) addenda are also contemplated for inclusion in the Surface Coating(s). Exemplary antistatic addenda and their preferred coating locations are taught by Markin et al U.S. Pat. No. 5,310,640 and Melpolder et al U.S. Pat. No. 5,547,821, cited above and here incorporated by reference.

Matting agents are also contemplated for inclusion in the Surface Coating(s). Any of the matting agents disclosed in *Research Disclosure* Item No. 17029, XI. Overcoat layers;

Przezdziecki U.S. Pat. No. 4,828,971; Mack et al U.S. Pat. No. 5,198,406; Melpolder et al U.S. Pat. No. 5,547,821; Kub U.S. Pat. No. 5,468,603; and Bjork et al U.S. Pat. No. 5,578,548, cited above and here incorporated by reference can be employed. Although matting agents are surface modifiers, they are recognized to be effective when coated either in a Surface Coating or in an underlying interlayer.

The Imaging Layer Units of the thermally processable elements of the invention can take any convenient conventional form. For example, the Imaging Layer Units can take any of the varied forms of photothermographic elements disclosed in *Research Disclosure*, Item No. 17029, cited above. These Imaging Layer Units can be alternatively used for thermographic imaging as constructed for photothermographic imaging use or they can be modified for thermographic use by removing photosensitive components to allow handling without radiation (e.g., ambient light) shielding.

In a preferred formulation, hereinafter referred to as a Type A formulation, each Imaging Layer Unit contains (a) a photosensitive silver halide (required only for photothermographic use), (b) a non-photosensitive reducible source of silver, (c) a reducing agent for silver ion, and (d) a binder.

Each of these components are conventional and can take any of the forms disclosed in Grant U.S. Pat. No. 3,080,254; Przezdziecki U.S. Pat. Nos. 4,741,992, 4,828,971 and 4,886,739; Mack et al U.S. Pat. No. 5,198,640; Markin et al U.S. Pat. No. 5,310,640; Kub U.S. Pat. No. 5,468,603 and Bjork et al U.S. Pat. No. 5,578,548, cited above and here incorporated by reference.

The photosensitive silver halide can take any conventional form known to be useful in photothermography. Most commonly the silver halide is a high (>50 mole %, based on Ag) bromide silver halide, such as silver bromide or silver iodobromide. Advantages have been recently demonstrated to flow from employing high (>50 mole %) chloride {100} tabular grain silver halide emulsions in photothermographic elements by Levy et al U.S. Ser. No. 08/740,110, filed Oct. 28, 1996, titled A PHOTOTHERMOGRAPHIC ELEMENT FOR PROVIDING A VIEWABLE RETAINED IMAGE, now allowed, commonly assigned and here incorporated by reference (UK Patent 2,318,645 corresponding).

The photosensitive silver halide can be employed in any conventional level within the photothermographic layer. As disclosed by Hanzalik et al U.S. Pat. No. 5,415,993, the silver halide can be present in a concentration as low as 0.01 percent by weight, based on the total weight of the photothermographic layer. It is preferred that the silver halide grains be present in a concentration of at least 5 and, optimally, at least 10 percent by weight, based on the total weight of the photothermographic layer. Silver halide grain concentrations of up to 35 percent by weight or higher, based on the total weight of the photothermographic layer are contemplated, but, for most imaging applications, it is preferred that the silver halide grains be present in concentrations of less than 25 (optimally less than 10) percent by weight, based on the total weight of the photothermographic layer.

The light-insensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70 percent by weight of the photothermographic layer. It is preferably present at a level of 30 to 55 percent by weight of the photothermographic layer.

To increase its sensitivity, the photosensitive silver halide is chemically sensitized. Conventional chemical sensitizers, such as chalcogen (e.g., sulfur and/or selenium), noble metal (e.g., gold) and reduction sensitizers, are summarized in *Research Disclosure*, Vol. 389, September 1996, Item 38957, IV. Chemical sensitization.

When the silver halide is intended to record exposures outside its region of native sensitivity (the near ultraviolet and, for some compositions, shorter blue wavelengths), it is conventional practice to adsorb one or more spectral sensitizing dyes to the surfaces of the silver halide grains. Useful spectral sensitizing dyes are summarized in *Research Disclosure*, Item 38957, V. Spectral sensitization and desensitization, A. Sensitizing dyes.

The organic silver salt is a silver salt which is comparatively stable to light, but forms a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, thiazole, imidazoline, imidazole, diazole, pyridine and triazine. Preferred examples of these heterocyclic compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)

4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzothiazole and a derivative thereof as described in Japanese patent publications 30270/69 and 18146/70, for example a silver salt of benzotriazole such as silver salt of methylbenzotriazole, etc., a silver salt of a halogen substituted benzotriazole, such as a silver salt of 5-chlorobenzotriazole, etc., a silver salt of 1,2,4-triazole, of 1H-tetrazole as described in U.S. Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* October 1983 (23419) and U.S. Pat. No. 3,985,565.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The reducing agent for the organic silver salt may be any material, preferably organic material, that can reduce silver ion to metallic silver. Conventional photographic developers such as 3-pyrazolidinones, hydroquinones, and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxyl amine, a reductone and/or a hydrazine, e.g., a combination of hydroquinone and bis(ethoxyethyl)hydroxylamine,piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bis-phenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbylpalmitate, ascorbylstearate and unsaturated aldehydes and ketones, such as benzyl and diacetyl; 3-pyrazolidones; and certain indane-1,3-diones.

Any conventional photothermographic layer binder can be employed. Conventional binders include hydrophilic colloid binders (e.g., hardened gelatin and gelatin derivatives), such as those disclosed in *Research Disclosure*, Item 38957, II. Vehicles, vehicle extenders, vehicle-like addenda and vehicle related addenda. The hydrophilic colloids disclosed therein principally as peptizers are also recognized to be useful binders and are employed in this invention employed principally as binders. Also contemplated for use as binders are synthetic resins such as polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic binders are poly(vinyl butyral), butylethyl cellulose, methacrylate copolymers, maleic anhydride ester copolymers, polystyrene, and butadiene-styrene copolymers.

It is specifically contemplated to employ organo-gel binders of the type disclosed by Hanzalik et al U.S. Pat. No. 5,415,993, the disclosure of which is here incorporated by reference.

The binders are employed in any convenient concentration for dispersing the components contained therein. Typically a preferred ratio of the binder to the light-insensitive, reducible silver source ranges from 15:1 to 1:2, most typically from 8:1 to 1:1. Since the binder and the light-insensitive, reducible silver source constitute the two highest concentration components of the photothermographic layer, it is preferred that these materials be chosen for maximum compatibility with this component. For example, whereas the light-insensitive, reducible silver source is a relatively hydrophilic material, such silver salts of compounds containing mercapto or thione groups, a hydrophilic colloid binder is favored, whereas, when the light-insensitive, reducible silver source is a more hydrophobic material, such as a silver soap or half soap—e.g., silver behenate, a synthetic resin binder, such as a vinyl acetal polymer or copolymer, is preferred.

In addition to the essential components of the Type A formulation described above, it is appreciated that various optional components can additionally be present. In forming viewable silver images tone modifiers, such as those illustrated by *Research Disclosure*, Item 17029, cited above, V. Tone Modifiers, are particularly important to modifying silver particle formation during development and hence providing a more uniform and pleasing image tone.

Examples of toners include phthalimide and N-hydroxyphthalimide; cyclic imides such as succinimide, pyrazoline-5-ones and a quinazolinone 1-phenylurazole, 3-phenyl-2-pyrazoline-5-one, quinazoline and 2,4thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, e.g., (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5[(3-ethyl-2-benzothiazolinylidene)-1-methyl-ethylidene]-2-thio-2,4-o-azolidinedione; phthalazine and phthalazine derivatives; 1-(2H)-phthalazinone and 1-(2H)-phthalazinone derivatives or metal salts of these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4dihydroxypyrimides, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene.

The preferred concentrations of toners are in the range of from 0.01 (most preferably 0.1) to 10 percent by weight, based on the total weight of the photothermographic layer.

Antifoggants and stabilizers for the photosensitive silver halide grains are preferably incorporated in the photothermographic layer. A variety of base generating materials, commonly referred to as activators, are conventionally employed in photothermographic layers to improve development. In order to simplify the coating compositions, activation and stabilization can be combined. Addenda in these classes are illustrated by *Research Disclosure*, Item 17029, cited above, IV. Activators/Activator-Stabilizers/Stabilizers, A. Activators and Activator Precursors, B. Stabilizers and Stabilizer Precursors, and C. Activator/Stabilizers and Activator/Stabilizer Precursors, and VIII. Antifoggants/Post-processing Print-Out Stabilizers.

Specifically preferred antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

It is additionally contemplated that the photothermographic formulation can be modified by eliminating the light-insensitive, reducible silver source and increasing the coating coverage of the photosensitive silver halide grains to compensate stoichiometrically for the removal of the light-insensitive silver source. In one particularly contemplated form of this type, referred to as a Type B formulation, the photothermographic layer is comprised of (a) photosensitive silver halide grains, including high chloride {100} tabular grains, as described above;
(b) an incorporated developing agent;
(c) one or a combination of an activator, an activator-stabilizer, and a stabilizer or stabilizer precursor; and
(d) a binder.

As described above both the Type A and B formulations upon imagewise exposure and thermal processing produce a viewable retained silver image. As variations of the Type A and B formulations above, hereinafter referred to as a Type A/D and B/D formulations, the developing or reducing agent can be chosen to form a dye image. For example, where the incorporated developing or reducing agent is a color developing agent, it can react with a dye-forming coupler to produce an azo dye image. Particularly useful color developing agents are the p-phenylenediamines and especially the N-N-dialkyl-p-phenylenediamines in which the alkyl groups or the aromatic nucleus can be substituted or unsubstituted. Common p-phenylenediamine color developing agents are N-N-diethyl-p-phenylenediamine monohydrochloride, 4-N,N-diethyl-2-methylphenylenediamine monohydrochloride, 4-(N-ethyl-N-2-methanesulfonyl-aminoethyl)-2-methylphenylenediamine sesquisulfate monohydrate, and 4-(N-ethyl-N-2-hydroxyethyl)-2-methylphenylenediamine sulfate. Other p-phenylenediamines, similar compounds, and their use include those described in Nakamura et al U.S. Pat. No. 5,427,897, Mihayashi et al U.S. Pat. No. 5,380,625, Haijima et al U.S. Pat. No. 5,328,812, Taniguchi et al U.S. Pat. No. 5,264,331, Kuse et al U.S. Pat. No. 5,202,229, Mikoshiba et al U.S. Pat. No. 5,223,380, Nakamuara et al U.S. Pat. No. 5,176,987, Yoshizawa et al U.S. Pat. No. 5,006,437, Nakamuara U.S. Pat. No. 5,102,778 and Nakagawa et al U.S. Pat. No. 5,043,254. Dye-forming couplers useful with color developing agents are illustrated by *Research Disclosure*, Item 38957, X. Dye image formers and modifiers, B. Image-dye-forming couplers.

Leuco dyes are another class of reducing agents that form a dye image upon oxidation. The leuco dye can be any colorless or slightly colored compound that can be oxidized to a colored form, when heated, preferably to a temperature of from about 80 to 250° C. for a duration of from 0.5 to 300 seconds. Any leuco dye capable of being oxidized by silver ion to form a visible image can be used.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes". These dyes are prepared by oxidative coupling of a p-phenylenediamine with a phenolic or anilinic compound. Leuco dyes of this class are described in U.S. Pat. No. 4,594,307.

A third class of dyes useful in this invention are "aldazine" and "ketazine" dyes. Dyes of this type or described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type ore described in Japanese Pat. No. 52-89131 and U.S. Pat. Nos. 2,784,186; 4,439,280; 4,563,415; 4,570,171; 4,622,395 and 4,647,525, all of which are incorporated hereby by reference.

Other illustrations of color materials are set out in *Research Disclosure*, Item No. 17029, cited above, XV. Color materials. Various conventional components that are employed in combination with dye image formers can additionally be present in the photothermographic layer. Such components include those set out in *Research Disclosure*, Item No. 38957, cited above, X. Dye image modifiers and addenda, C. Image dye modifiers, D. Hue modifiers/stabilization, and E. Dispersing dyes and dye precursors. Dye image stabilizers, such as those set out in paragraph (3) of section D, are particularly preferred components.

In each of Elements A through H described above each of the Imaging Layer Units can consist of a single layer in its simplest form. It is recognized that imaging advantages can be realized by dividing an Imaging Layer Unit into two or more layers in photothermographic applications. For example, it is generally appreciated that dividing a photothermographic Imaging Layer Unit into a faster imaging layer located to first receive exposing radiation and a slower imaging layer can increase imaging speed without a proportionate increase in granularity as compared to a single layer containing the same total ingredients.

When Elements A through F are employed for recording the natural colors of photographic subjects, the Imaging Layer Unit is contemplated to be divided into blue, green and red recording layers. For example, when the Imaging Layer Unit of Element C above is constructed in this manner, the following resulting element represents a preferred construction:

| |
|---|
| Surface Coating |
| Blue Recording Layer |
| First Interlayer |
| Green Recording Layer |
| Second Interlayer |
| Red Recording Layer |
| Support |
| Surface Coating |

Element I

Each of the Blue, Green and Red Recording Layers can be divided, if desired, into faster and slower layers, as noted above. The Recording Layer order in Element I is that most commonly employed in photothermographic elements employing a silver halide that possesses native blue sensitivity. This layer order arrangement allows a blue light absorber, such as Carey Lea silver or a yellow dye, to intercept blue light passing through the Blue Recording Layer before it reaches the Green and Red Recording Layers. Silver halides that possess little or no native blue light sensitivity, such as those lacking silver iodide as a component and particularly high (>50 mole % based on Ag) chloride silver halides, allow the First Interlayer blue light absorber to be omitted with little or no performance penalty and allow the Blue, Green and Red Recording Layers to be coated in any desired sequence.

The First and Second Interlayers preferably employ a binder similar to that of the contiguous photothermographic layers and, if required by the dye image formers chosen, additionally contain an antistain agent (e.g., oxidized developing agent scavenger) to minimize color contamination by migrating reactants. Antistain agents are illustrated by *Research Disclosure*, Item 38957, cited above, X. Dye image formers and modifiers, D. Hue modifiers/stabilization, paragraph (2).

The Supports can take any convenient conventional form employed in thermally processable elements. Supports are chosen for transparency or reflectance, as noted above. They are required to exhibit dimensional stability, to withstand elevated processing temperatures, to form an adhesive bond to coatings that contact them directly, and to be chemically compatible with the layers they receive as coatings, particularly the imaging layer. *Research Disclosure*, Item 17029, XVII. Supports summarizes conventional paper and film supports. Film support compositions elaborated are only those required to satisfy the more stringent thermal processing requirements. For the less stringent conventional thermal processing requirements, conventional film supports of the type also employed in aqueous processed radiographic elements are contemplated. These supports are summarized in *Research Disclosure*, Vol. 184, August 1979, Item 18431, XII. Film Supports. Also thermally stable film supports can be selected from among those conventionally employed for aqueous processed photographic elements, as illustrated in *Research Disclosure*, Item 38957, XV. Supports.

Although the Blue, Green and Red Recording Layers are constructed to produce yellow, magenta and cyan dye images when used for printing, it is recognized that it is now well recognized that, where the dye image information is intended to be retrieved by scanning, the dye images can be of any three distinguishable hues. Further, principal dye absorptions are not limited to the visible spectrum. The peak dye absorptions can occur in any three distinguishable locations ranging from the near ultraviolet to the near infrared.

In photothermographic use, the photothermographic elements of the invention can be exposed to any type of radiation to which the silver halide grains are responsive—that is, which is capable of forming a developable latent image. These various forms of radiation are summarized in *Research Disclosure*, Item 38957, XVI. Exposure. Visible light, electromagnetic radiation of wavelengths conveniently emitted by photodiodes and lasers (including the visible spectrum and the near infrared), and X-radiation exposures are particularly contemplated.

Following imagewise exposure the photothermographic elements of the invention are uniformly heated to temperatures ranging from about 80 to 240° C., most typically between about 100 and 200° C. Placing the photothermographic element on a heated carrier or passing the photothermographic element between heated rollers are commonly practiced heating techniques. The optimum processing temperature is chosen to strike a balance against the physical thermal stresses inherent at the higher temperature levels and the faster thermal processing times that these higher temperature levels permit.

When the elements of the invention are employed as thermographic elements the photosensitive components (e.g., silver halide) are preferably absent. An internal image is created by transmitting imagewise applied heat, such as from a laser beam or a stylus, to the Imaging Layer Unit(s). The same temperature ranges are useful in photothermographic and thermographic imaging.

Immediately following thermal processing the incorporated image is available for viewing, printing, scanning or further manipulation, depending upon the specific imaging use intended.

EXAMPLES

The invention can be better appreciated by reference to the following specific embodiments and comparisons. All percentages are weight percentages based on total weight, unless otherwise indicated.

Condensed Name Listing

CP Chlorowax™, a chlorinated parafin, available from OxyChem

FC-3M the formula (I) comparison compound propyltrimethoxysilane

FC-6E the formula (I) comparison compound phenyltriethoxysilane

F(I)-12E the formula (I) compound dodecyltriethoxysilane

F(I)-18E the formula (I) compound octadecyltriethoxysilane

F(I)-18M the formula (I) compound octadecyltrimethoxysilane

M-1 1.5 $\mu$m mean size poly(methyl methacrylate) matte particles

M-2 5.5 $\mu$m mean size poly(methyl methacrylate) matte particles

PDMS General Electric SF-96-200™, poly (dimethylsiloxane)

PSA Poly(silicic acid), prepared by hydrolyzing tetraethoxy ortho silicate

PVA Elvanol 52-22™, poly(vinyl alcohol), available from DuPont, 86–89% hydrolyzed PVB Butvar 76™, poly(vinyl butyral), molecular weight 90,000–120,000, available from Monsanto SS-1 The spectral sensitizing dye anhydro-3-ethyl-9,11-neopentylene-3'-(3-sulfopropyl)thiadicarbocyanine hydroxide CA-1 Dowanol™, the coating aid 2-phenoxyethanol, available from Dow Chemical Co.

SF-1 Zonyl FSN™, perfluoroalkylpolyoxyethylene, a nonionic surfactant, available from DuPont SF-2 Olin 10G™, a para-isononylphenoxypolyglycidol nonionic surfactant, available from Olin Corp.

SF-3 Lodyne S-100™, an anionic surfactant, a mixture of $R^f(CH_2)_2SCH(CO_2H)CH_2CONH(CH_2)_3N(CH_3)_2$ and $R^f(CH_2)_2SCH(CH_2CO_2H)CONH(CH_2)_3N(CH_3)_2$ where $R^f$ is a mixture of $C_6F_{13}$, $C_8F_{17}$ and $C_{10}F_{21}$ available from Ciba-Geigy

Example 1

Control Element A

A thermally processable imaging element was prepared by coating a blue (0.14 density) poly(ethylene terephthalate) support, having a thickness of 0.178 mm, with a photothermographic imaging layer and a surface coat. The photothermographic imaging composition was coated from a solvent mixture containing 73.5% 2-butanone, 11.0% toluene, 15% methanol and 0.5% SF-1 at a wet coverage of 89 cc/m$^2$ to form an imaging layer of the following dry composition:

Imaging Layer

| Components | Dry Coverage (g/m$^2$) |
|---|---|
| Succinimide | 0.193 |
| Phthalimide | 0.377 |
| PDMS | 0.007 |
| 2-bromo-2-[(4-methylphenyl)sulfonyl]acetamide | 0.104 |
| Naphthyl triazine | 0.025 |
| Palmitic acid | 0.126 |
| N-(4-hydroxyphenyl)-benzenesulfonamide | 2.321 |
| Silver, as silver bromide | 0.551 |
| SS-1 | 0.005 |
| Silver, as silver behenate | 9.327 |
| PVB | 7.150 |
| Mercury, as mercuric bromide | 0.002 |
| CP | 0.715 |
| Trimethylborate | 0.154 |

The resulting imaging layer was then overcoated with mixture of PVA and hydrolyzed tetraethyl orthosilicate, a source material for forming PSA) along with other ingredients described below at a wet coverage of 40.4 g/m$^2$ and dried to give the indicated dry coverages:.

Surface Coating

| Components | Dry Coverage (g/m$^2$) |
|---|---|
| PSA | 2.3078 |
| PVA | 1.5433 |
| SF-1 | 0.0044 |
| SF-2. | 0.0396 |
| Aniline Blue tinting dye | 0.0055 |
| M-1 | 0.0165 |

The PSA was prepared by mixing 29.4 weight percent water, 1.2% 1 N p-toluene-sulfonic acid, 34% methanol and 35.4% tetraethoxysilane to form a 16.3% polysilicic acid solution;

Example Elements B–D

These elements were prepared similarly as Control Element A, except that a 10% solution in ethanol of the alkoxysilane F(I)-18M, satisfying invention requirements, in the amounts indicated in Table I below, were added to the surface coating composition prior to coating.

Friction Testing Procedure

A contact element CE-1 was prepared to allow the surface coating's friction level to be tested. CE-1 was prepared by coating a mixture of PVA, hydrolyzed tetraethyl orthosilicate, and other ingredients to provide the final contact coating composition shown below onto a subbed poly (ethylene terephthalate) support having a thickness of 0.178 mm.

Contanct Coating

| Components | Dry Coverage (g/m$^2$) |
|---|---|
| PSA | 1.3189 |
| PVA | 0.8822 |
| SF-3 | 0.0006 |
| SF-2 | 0.0330 |
| M-2 | 0.0550 |

After CE-1 was fully formed and dried, testing of each imaging element was undertaken by placing CE-1, contact coating up, on a flat bed and placing a 10.2 cm diameter circular sample square of the imaging element with the surface coat laid against the contact coating of CE-1. A 900 g weight was then placed on the imaging element sample. After 15 seconds, the flat bed was tilted at a fixed rate of 1 degree per second. Movement of the flat bed was stopped when movement was observed between CE-1 and the sample.

The tilt angle of the flat bed was then measured. The friction comparison is reported below in Table I as the tangent of the tilt angle. For reference, a 0° tilt angle has a tangent of zero and a 45° tilt angle has a tangent of 1. Table I correlates the presence and amount of the alkoxysilane of formula (I) F(I)-18 with the friction observation.

TABLE I

| Sample | F(I)-18M (g/m$^2$) | Friction |
|---|---|---|
| A | 0 | 0.43 |
| B | 0.011 | 0.28 |
| C | 0.022 | 0.33 |
| D | 0.044 | 0.31 |

From Table I it is apparent that even at the lowest concentrations the alkoxysilane satisfying formula (I) reduced surface coating friction.

Example 2

Example 1 was repeated, but with varied alkoxysilanes containing a hydrocarbon substituent lacking the minimum of 12 carbon atoms required by formula (I) being compared to the absence of an alkoxysilane in the surface coat and an alkoxysilane satisfying formula (I) in the surface coat. The effect of varying alkoxy groups is also demonstrated.

Surface Coating

| Components | Dry Coverage (g/m$^2$) |
|---|---|
| PSA | 1.3189 |
| PVA | 0.8822 |
| SF-1 | 0.0044 |
| SF-2. | 0.0330 |
| Aniline Blue tinting dye | 0.0026 |
| M-1 | 0.011 |

In addition, the measurement of the contact angle of a drop of water was undertaken to provide an indirect indication of surface properties. The water contact angle was measured using a Rame-Hart contact angle goniometer.

The correlation of friction measurements, contact angles, and alkoxysilane selections and concentrations is set out in Table II.

TABLE II

| Sample | Silane | Dry coverage silane (g/m$^2$) | Friction | Contact Angle (°) |
|---|---|---|---|---|
| E | none | 0 | 0.59 | 60 |
| D | F(I)-18M | 0.0011 | 0.43 | 88 |
| F | F(I)-18M | 0.0055 | 0.39 | 96 |
| G | F(I)-18M | 0.011 | 0.34 | 98 |
| H | F(I)-12E | 0.011 | 0.40 | 97 |
| I | F(I)-18E | 0.011 | 0.48 | 82 |
| J | FC-3M | 0.011 | 0.54 | 66 |
| K | FC-E | 0.011 | 0.54 | 64 |

From Table II it is apparent that the number of carbon atoms in the saturated hydrocarbon substituent of the alkoxysilane (the number that appears in the condensed name) is the primary determinant of friction properties. All of the alkoxysilanes tested reduce friction, but there is a marked advantage for the alkoxysilanes that contain 8 or more carbon atoms in the saturated hydrocarbon moiety. The number of carbon atoms in the alkoxy moiety is less important, but can be seen to also have an effect on friction. Comparing F(I)-18E and F(I)18M, it is apparent that reducing the number of carbon atoms in the alkoxy moiety performance, resulting in significantly lower friction.

Example 3

This Example demonstrates the importance of confining the alkoxysilane satisfying formula (I) to the surface coating.

Three thermally processable imaging elements L, M and N were constructed with the sole variation being placement of the alkoxysilane in the imaging layer only (Control L), in both the imaging layer and the surface coating (Control M), and in only the surface coating (Example N).

Excluding the possible inclusion of the alkoxysilane, the following is the dry coated composition of the imaging layer common to each of elements L, M and N:

Imaging Layer

| Components | Dry Coverage (g/m$^2$) |
|---|---|
| Succinimide | 0.3484 |
| Phthalimide | 0.3484 |
| PDMS | 0.0070 |
| 2-bromo-2-[(4-methylphenyl)sulfonyl]acetamide | 0.1103 |
| Naphthyl triazine | 0.0267 |
| Palmitic acid | 0.1336 |
| N-(4-hydroxyphenyl)-benzenesulfonamide | 2.7179 |
| Silver, as silver bromide | 0.5831 |
| SS-1 | 0.0056 |
| Silver, as silver behenate | 8.4208 |
| PVB | 8.7112 |
| Mercury, as mercuric bromide | 0.0014 |
| CP | 0.8711 |
| Sodium Iodide | 0.0002 |

Excluding the varied inclusion of the alkoxysilane, the surface coating was identical to that of Control A in Example 1.

The alkoxysilane F(I)-18M was incorporated in a concentration of 0.616 g/m$^2$ in the imaging layer only in Control L; in a concentration of 0.616 g/m$^2$in the imaging layer and a concentration of 0.022 g/m$^2$ in the surface coat in Control M; and in a concentration of 0.022 g/m$^2$ in the surface coat only in Example N.

The support and the method of coating were as described above in connection with Element A.

Tape Adhesion Test

This test was conducted to provide a comparison of the adhesion of the surface coating to the imaging layer. A 35 mm strip sample of an element was cut and a piece of #810 Scotch™ tape was applied across the surface coating of the sample. After peeling the tape from the surface coating, the amount of surface coat removal was visually noted and a rating was assigned:

Good=no removal,

Fair=partial removal,

Poor=complete removal.

Neither Fair nor Poor are acceptable to permit conventional handling of a thermally processable imaging element.

Paper Clip Friction Test

This test was undertaken to provide a comparison of the surface friction exhibited by the thermally processable elements. A paper clip held by a plastic arm with a mass of 63 grams was placed in contact with an element sample on a flat bed. After 15 seconds, the flat bed was tilted at a fixed rate of 1 degree per second. Movement of the flat bed was stopped when movement was observed of the sample relative to the paper clip, and the angle to which the bed had been tilted was noted. The tangent of the angle of the bed was taken as an indication of the static friction characteristic of the surface coating of the sample.

The results are summarized below in Table III:

TABLE III

| Sample | F(I)-18M in Imaging Layer | F(I)-18M in Surface Coat | Paper clip friction | Surface Coat Adhesion |
|---|---|---|---|---|
| L | Yes | No | 0.28 | Poor |
| M | Yes | Yes | 0.12 | Poor |
| N | No | Yes | 0.12 | Good |

From Table III it is apparent that inclusion of an alkoxysilane satisfying formula (I) in the surface coat reduced surface friction. However, when the formula (I) compound was placed in both the surface coat and the imaging layer or even in only the imaging layer, poor surface coat adhesion was observed. Thus, only when the formula (I) compound was confined to the surface coat were both properties fully satisfactory.

Example 4

This example demonstrates importance of having an alkoxysilane satisfying formula (I) in the surface coat. This example particularly demonstrates the effects when the formula (I) compound is absent from the surface coat or when a functionally substituted hydrocarbon replaces the hydrocarbon substituent in the alkoxysilane.

Example Element N was constructed as described in Example 3 above. This element contained in the surface coat F(I)-18M, that is:

$$C_{18}H_{37}—Si—(OCH_3)_3$$

Control Element O differed from Element N in that the alkoxy silane F(I)-18M was omitted from the surface coat.

Control Element P differed from Element N in that the formula (I) $R^1$ saturated hydrocarbon group of F(I)-18M was replaced with an equal amount of glycidoxypropyltrimethoxysilane—that is, the epoxy functional group containing glycidoxypropyl substituent replaced the $C_{18}H_{37}$-substituent in F(I)-18M.

Control Element Q differed from Element N in that the formula (I) $R^1$ saturated hydrocarbon group of F(I)-18M was replaced with an equal amount of aminopropyltrimethoxysilane—that is, the amino functional group containing aminopropyl substituent replaced the $C_{18}H_{37}$-substituent in F(I)-18M.

To same friction test described in Example 3 was employed to test the friction properties of the elements. The results as a function of formula (I) $R^1$ values are summarized below in Table IV.

TABLE IV

| Element | $R^1$ group | Hydrocarbon Substituent | Paper-clip friction |
|---|---|---|---|
| N | $C_{18}H_{37}$— | None | 0.12 |
| O | no alkoxysilane included | | 0.28 |
| P | glycidoxypropyl- | epoxy | 0.28 |
| Q | aminopropyl- | arnine | 0.28 |

From Table IV it is apparent that a functional substituent to the saturated hydrocarbon of $R^1$ effectively eliminated the friction reducing property of the resulting alkoxysilane.

The invention has been described in detail with particular reference to certain preferred embodiments thereof, but it will be understood that variations and modifications can be effected within the spirit and scope of the invention.

What is claimed is:

1. A thermally processable imaging element, said element being comprised of a support;

at least one thermographic or photothermographic imaging layer coated on the support, and a surface coating containing a film-forming binder overlying at least one major surface of the element, WHEREIN a friction reducing compound is confined to the surface coating and is represented by the formula:

$$(R^1)_{4-y}—Si—(OR^2)_y$$

in which $R^1$ consists of a saturated hydrocarbon containing from 8 to 32 carbon atoms, $R^2$ is an alkyl group of from 1 to 4 carbon atoms, and y is an integer of from 1 to 3.

2. A thermally processable imaging element according to claim 1 wherein the surface coating overlies the imaging layer.

3. A thermally processable imaging element according to claim 1 wherein the surface coating and the imaging layer are coated on opposite sides of the support.

4. A thermally processable imaging element according to claim 1 wherein the surface coating additionally contains polysilicic acid.

5. A thermally processable imaging element according to claim 1 wherein the film-forming binder is comprised of a water soluble hydroxyl containing polymer.

6. A thermally processable imaging element according to claim 1 wherein the surface coating additionally includes a matting agent.

7. A thermally processable imaging element according to claim 1 wherein y is 3.

8. A thermally processable imaging element according to claim 1 wherein $R^2$ is methyl or ethyl.

9. A thermally processable imaging element according to claim 1 wherein the imaging layer contains a non-photosensitive source of silver and a reducing agent for silver ion.

10. A thermally processable imaging element according to claim 9 wherein the imaging layer additionally contains photosensitive silver halide.

11. A thermally processable imaging element according to claim 1 wherein the saturated hydrocarbon contains from 12 to 24 carbon atoms.

12. A thermally processable imaging element, said element being comprised of a transparent film support;

at least one thermographic or photothermographic imaging layer unit coated on the support comprised of an organic silver salt capable of releasing silver ion for imaging, a reducing agent for silver ion, and a poly (vinyl acetal) binder, and overlying the imaging layer unit a surface coating containing a film-forming binder and a friction reducing compound confined to the surface coating and represented by the formula:

$$R^1—Si—(OR^2)_3$$

in which $R^1$ consists of a saturated aliphatic hydrocarbon containing from 12 to 24 carbon atoms and $R^2$ is an alkyl group containing 1 or 2 carbon atoms.

13. A thermally processable imaging element according to claim 12 additionally including in the imaging layer unit a photosensitive silver halide.

* * * * *